United States Patent [19]

Cox et al.

[11] 4,362,538

[45] Dec. 7, 1982

[54] WET ELECTROSTATIC PRECIPITATOR HAVING MEANS FOR DAMPENING THE SWAYING OF ITS DISCHARGE ELECTRODES

[75] Inventors: Karl Cox, Tempe; Keith Collins, Mesa, both of Ariz.

[73] Assignee: Dresser Industries, Inc., Dallas, Tex.

[21] Appl. No.: 295,971

[22] Filed: Aug. 25, 1981

[51] Int. Cl.[3] ..... B03C 3/16; B03C 3/41

[52] U.S. Cl. ..... 55/118; 55/145; 55/147; 55/148; 55/153

[58] Field of Search ..... 55/13, 118, 119, 141, 55/143, 145, 147–149, 150, 153

[56] References Cited

U.S. PATENT DOCUMENTS

| | | | |
|---|---|---|---|
| 2,506,996 | 5/1950 | Crowder | 55/148 |
| 2,737,259 | 3/1956 | Harlow | 55/147 |
| 3,483,671 | 12/1969 | Wiemer | 55/147 |
| 3,703,799 | 11/1972 | Humphreys | 55/147 |
| 4,134,040 | 1/1979 | Klotzman | 55/148 |

*Primary Examiner*—David L. Lacey

[57] ABSTRACT

A wet electrostatic precipitator includes flat discharge electrodes (14) of a grid-like construction that have some flexibility so that if sparking occurs between their freely suspended lower ends and the adjacent collector plates (12), the lower ends will tend to sway back and forth. Oscillation dampener devices (50) are suspended upon the lower ends of the electrodes and are comprised of a cylindrical mass or body portion (82) rigidly connected to a rail portion (80) by arms (84). Each dampener is pendulously suspended upon a cross member (56) of the frame of the associated electrode so that its rail portion rubs against the cross member with enough friction to rapidly inhibit the swaying of the lower end of the electrode under the influence of any sparking.

6 Claims, 4 Drawing Figures

WET ELECTROSTATIC PRECIPITATOR HAVING MEANS FOR DAMPENING THE SWAYING OF ITS DISCHARGE ELECTRODES

BACKGROUND OF THE INVENTION

The present invention generally relates to wet electrostatic precipitators and more particularly concerns to wet electrostatic precipitators of the type that include a flat discharge electrode structure that is vertically suspended from an overhead support structure.

In wet electrostatic precipitators of the type shown, for example, in U.S. Pat. No. 4,181,509, the discharge electrodes and collector plates have annular shapes and are vertically arranged in concentric relationships. The discharge electrodes are suspended from an overhead support structure so that the lower ends are not connected to a support. Due to the inherent rigidity in the annular shape of the electrodes, there has been no problem regarding oscillation of the lower ends of the discharge electrodes.

Trade literature by the Mikropul Corporation entitled, Elektrofil Wet Electrostatic Precipitators, discloses another type of wet electrostatic precipitator in which the discharge electrodes and collector plates are flat and are vertically arranged in uniformly spaced, parallel relationships. The flat discharge electrodes are as in the aforementioned patent, suspended only from their upper ends.

Trade literature by the Envirotech Corporation entitled, Fluid-Ionics Systems Fluid-Plate Modular Wet Precipitator, discloses a wet electrostatic precipitator including flat discharge electrodes and collector plates vertically arranged in uniform spacings. The discharge electrodes are suspended from a pair of support tubes made from conductive metal, and a potential is applied to the tubes to charge the discharge electrodes. The precipitator further includes a housing surrounding the electrodes, air inlet and outlet hoods mounted to the top and bottom of the housing, respectively, and scrubber sprayers mounted to the inlet hood.

A major problem that has occurred in the testing of the wet electrostatic precipitator of type shown in the last-mentioned article concerns the oscillation or swinging of the lower ends of the discharge electrodes. It has been observed that the sparking that sometimes occurs between the lower ends of a discharge electrode and collector plate can cause the flat electrodes to sway. Such swaying sometimes can increase in magnitude so that the sparking is so great that the electrostatic field is reduced below the voltage level required for proper precipitation action.

It has been found that this spark-induced oscillation problem cannot be easily cured by simply connecting the lower ends of the discharge electrodes to the housing or cross members thereat. Since the precipitator is operated wet, i.e., liquid is constantly flowing downwardly over the collection plates and dripping from the discharge electrodes, a rigid connection to the lower ends of the electrodes—no matter how well electrically insulated—would become covered with liquid, thus providing a leak path to ground potential.

U.S. Pat. No. 4,167,400 shows a electrode restraining assembly intended for use in a dry electrostatic precipitator. The device includes a grid attached to nonconductive plates that are, in turn, attached to the sidewalls of the precipitator. The discharge electrodes are comprised of wiring and weights are suspended from the wires.

U.S. Pat. No. 4,189,308 describes the aforementioned sparking phenomenon in connection with a parallel plate type of wet electrostatic precipitator.

SUMMARY OF THE INVENTION

The present invention overcomes the aforementioned oscillation problem by pendulously suspending weights from the lower ends of the discharge electrodes so that the weights can swing with substantial friction thereagainst. The substantial friction between the electrode and the pendulously suspended weights dampens oscillation of the electrode that may be induced by sparking.

In the preferred embodiment, the discharge electrodes are each comprised of a flat metal frame and relatively thin strands of wire attached to the frame to form a flat grid. Each frame is attached at its upper end to electrically charged support members, and each frame includes a cross member near its lower end upon which the weight member (hereinafter called an oscillation dampener) is suspended. The oscillation dampener is preferably comprised of an elongate support member (hereinafter called the support rail) having a shape in cross section to rub against the cross member of the associated electrode frame at opposite sides thereof. The weight member further includes a pendulum mass or body rigidly attached to the support rail by a connecting member or members. The substantial friction between the support rail and the cylindrical rail of the electrode frame under the weight of the pendulum body is sufficient to inhibit swinging of the dampener and, perhaps with the use of more than one dampener, to thereby dampen the swinging of the lower end of the electrode frame. The length of the support rail assures that as the flat electrode frame sways, the elongate pendulum body will remain generally in the original plane of the discharge electrode, thus minimizing any sparking between the pendulum body and the adjacent collector plates.

DESCRIPTION OF THE PREFERRED EMBODIMENT

Figure 1:
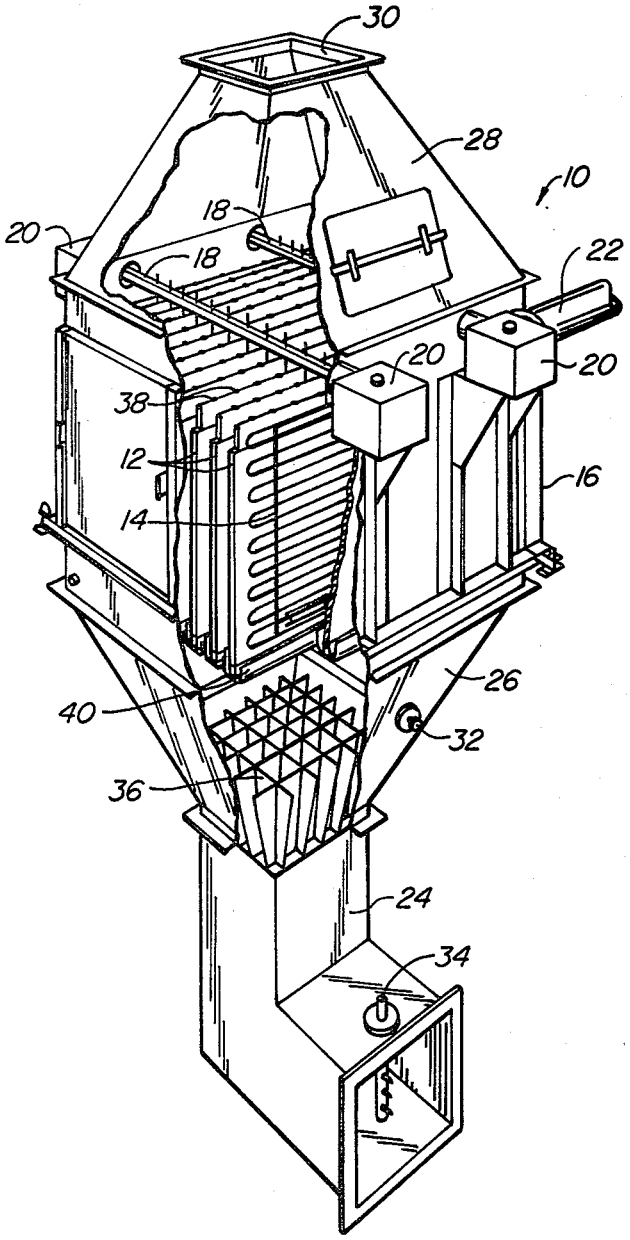
FIG. 1 is a diagrammatic perspective view of a wet electrostatic precipitator incorporating the present invention, with parts thereof being broken away to better illustrate the discharge electrodes and their mounting within the precipitator.

Referring now more particularly to FIG. 1, it will be seen that a wet electrostatic precipitator includes a plurality of flat collector plates 12 (shown diagramatically) and a plurality of discharge electrodes 14. The collector plates 12 are arranged in uniformly vertical relationship within a rectangular housing 16. The discharge electrodes 14 are vertically suspended from a pair of overhead electrode support beams 18 made from electrically conductive metal pipes. The electrodes are vertically suspended so that each electrode is equidistantly spaced between each adjacent pair of collector plates. The ends of the support beams are suspended within boxes 20 so that the support beams are electrically insulated from the housing 16. The support beams are charged by a high voltage bus 22 connected to the end of the one of the support beams. In this manner, the discharge electrodes 14 are charged through their mechanical connection to the beams 18.

Particulate laden air is fed into an elbow 24 connected to the lower end of an air inlet hood 26 that is, in turn, connected to the lower end of the housing 16. A discharge hood 28 is connected to the upper end of the housing 16, and air having particulates removed therefrom is discharged through an opening 30 in the upper end of the upper hood. Scrubber sprayers 32 and 34 are respectively mounted in the air inlet hood 26 and elbow 24 to spray the incoming air. A straightening vane assembly 36 of an egg-crate construction is provided at the entrance end of the inlet hood.

Water is pumped from nozzles 38 arranged in uniformly spaced locations along the upper end of each collector plate 12. More particularly, a header member is connected between the sidewalls of the housing at the top end of each collector plate, and a plurality of weir type nozzles are arranged along the upper end of each header member. Water is provided, as in any wet electrostatic precipitator, to flush particles or droplets attracted to the collector plates as a result of the electrostatic field generated between the discharge electrodes 14 and the collector plates. The water having the separated particulates therein is collected in troughs arranged directly below the lower ends of the collector plates.

As previously indicated, it has been found that sparking at the lower end of the discharge electrodes 14 causes the electrodes to sway back and forth between the collector plates 12. This swaying is exacerbated by the fact that as the electrodes start swaying, the spark gap between the lower ends of the electrodes and the collector plates reduces thereby increasing the intensity of the sparking, thereby tending to cause the electrodes to sway at even larger amplitudes. It is noted that it is not possible to reduce the voltage supplied to the discharge electrodes without reducing the separation effectiveness of the precipitator. The present invention therefore provides means for dampening the oscillation of electrodes without otherwise affecting the performance of the precipitator.

Figure 2:
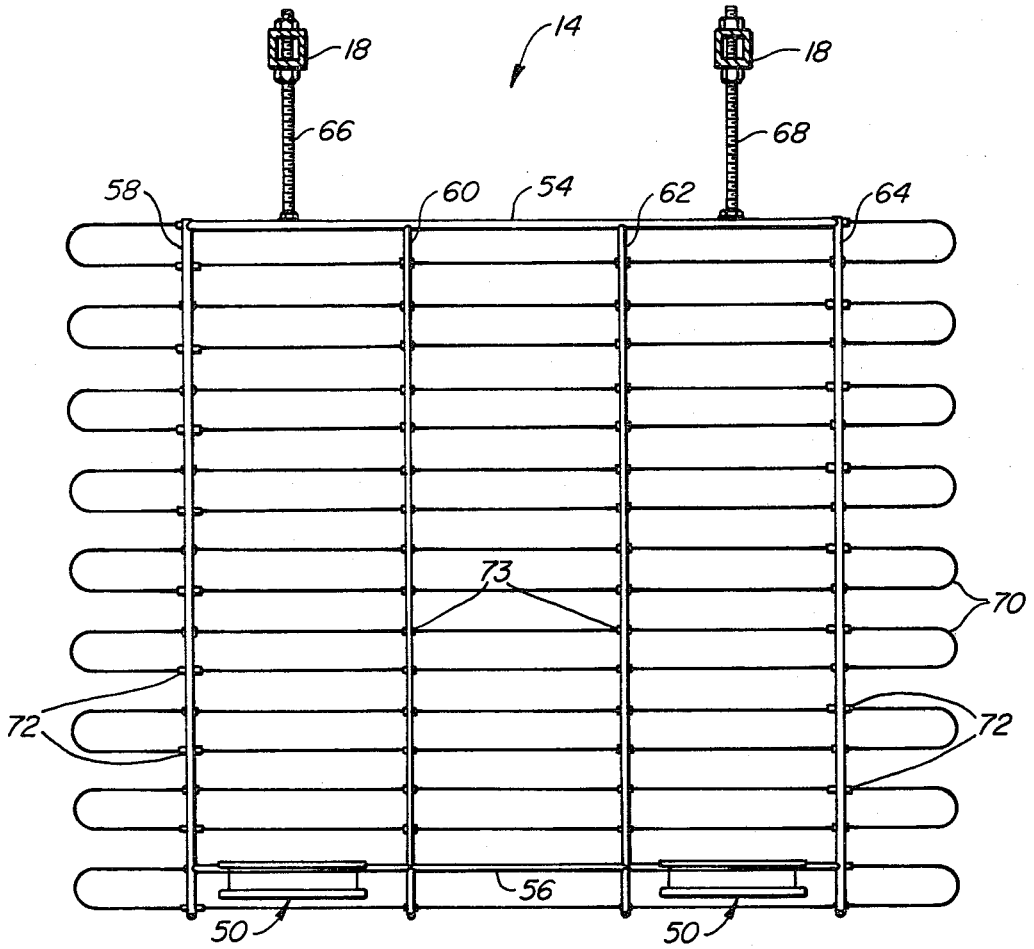
FIG. 2 is a side elevation of a discharge electrode, further illustrating its suspension from a pair of overhead support beams.
Figure 3:
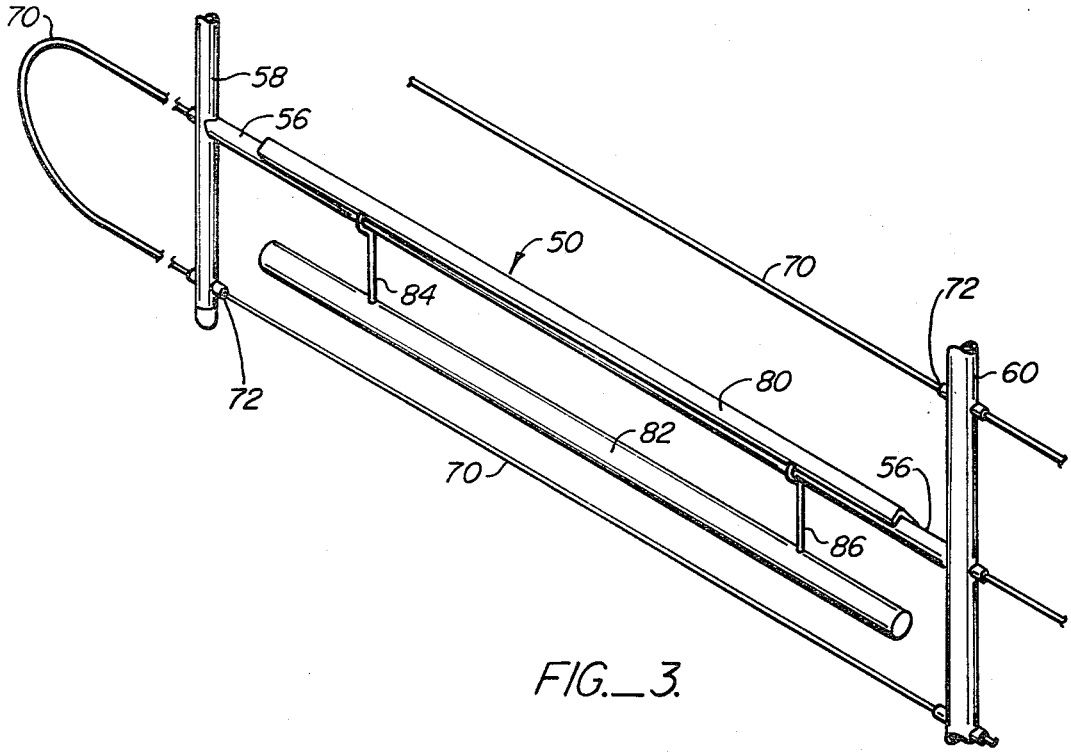
FIG. 3 is an enlarged fragmentary perspective view illustrating an oscillation dampener and its suspension on the lower cross member of a discharge electrode.

Referring now to FIGS. 1–3, it will be seen that two oscillation dampener devices 50 are suspended from the lower end of each discharge electrode 14. The discharge electrodes are comprised of a flat frame of rectangular outline including a top cross member 54 and a bottom cross member 56. The frame is constructed of conductive metal tubing that is corrosion resistant, such as a high nickel steel alloy. The electrode frame further comprises four equally spaced relatively long upright members 58, 60, 62, 64 connected between the upper and lower frames 54 and 56. The frame further includes threaded rods 66 and 68 extending upwardly parallel to the members 58, 60, 62, 64. These rods are received within apertures formed in the support tubes 18 and are removably secured to the support tubes by suitable fasteners. The frame will be appreciated to be flexible so that its lower end may sway or flex back and forth.

Each discharge electrode 14 further includes wire loops 70 formed of relatively thin strands. These wire strands 70 are mechanically connected to the upright members 58, 60, 62, 64 of the electrode frames by crimp tubes 72. The electrode wires are loosely received in guide sleeves 73 affixed to the end vertical members between the crimp tubes and affixed to the center members 60 and 62. This electrode construction is relatively flexible since the wires are connected to the electrode frame only at their top ends.

Figure 4:
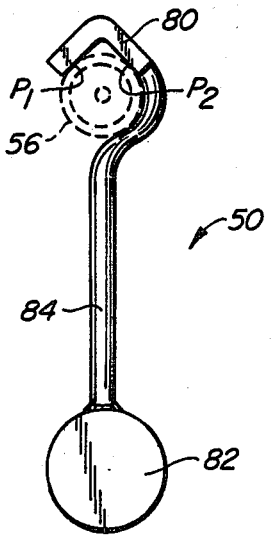
FIG. 4 is an enlarged end view of an oscillation dampener, with the outline of the electrode cross member being shown in dashed outline.

As previously noted, in accordance with the present invention, a pair of oscillation dampening devices 50 are pendulously suspended from the lower cross member 56 between the end two upright members. Each oscillation dampener device 50 comprises a pendulum suspended from a rail 80 adapted to permit the pendulum to swing at right angles with the plane of the discharge electrode. The rail is engaged upon the cross member 56 of the electrode frame in frictional contact therewith. The pendulum portion of each dampener device includes a heavy body or mass 82 formed of a solid cylindrical rod of metal and stiff support arms or shafts 84 and 86 rigidly connected to an edge of the rail. Referring to FIG. 4 it will be seen that the rail has a cross section of a V-shape or a right angle shape to thereby engage the cross member 56 at two line areas of contact (indicated by the points $P_1$ and $P_2$ in FIG. 4) at opposite sides of the cross member. As also shown in FIG. 4, each connecting member 84, 86 includes a straight portion affixed to the mass 82 and a curved portion affixed to one edge of the rail 80 so that the mass is horizontally disposed and so that it normally comes to rest directly under the cross member 56, that is, so that the elongate mass portion 82 normally lies within the plane of the flat electrodes 14.

In operation, if sparking should occur between the lower end of the discharge electrode 14 and one of the adjacent collector plates 12, such sparking would have a tendency to cause the lower end to sway. It is noted that even though the tubular electrode frame is relatively rigid, it still has some flexibility so that the lower end of the electrode frame will flex or sway relatively to the upper end thereof that is rigidly connected to the support beams 18. The oscillation dampener devices 50 inhibit the swaying of the associated electrode through their frictional engagement with the cross member 56 of the electrode frame. Due to the heavy mass and pendulous suspension of the dampener devices on the cross member, the elongate mass 82 of the device tends to remain generally in the original vertical plane of the electrode, thereby causing the rail portion 80 to rub against the metal cross member 56. It has been observed that the oscillation dampener devices of the preferred embodiment shown and described herein quickly inhibit or dampen oscillations, so that no substantial oscillations occur under normal sparking conditions.

Accordingly, the present invention provides a device for dampening the oscillation of a suspended discharge electrode in a wet electrostatic precipitator in a manner that eliminates concern about a reduction in effectiveness of the precipitator caused by normal sparking. The wet electrostatic precipitator may therefore be set at a relatively high voltage level to maintain maximum electrostatic field without concern about undue swaying of the discharge electrodes. At the same time, due to the fact that the oscillation damper devices 50 are freely suspended from the electrode frames, and the fact that these devices are not connected to the housing 16, there is no concern about a substantial current discharge path through the dampener devices to the precipitator housing or collector plates.

Although the best mode contemplated for carrying out the present invention has been shown and described, it will be apparent that modification and variation may be made without departing from what is regarded to be subject matter of the invention.

What is claimed is:

1. A wet electrostatic precipitator comprising a housing having an inlet to receive gas to be treated and an outlet to discharge treated gas, a plurality of generally flat discharge electrode structures, means for rigidly suspending the electrode structures from their upper ends within the housing in the flow path of the gas such that the electrodes are generally parallel to each other and substantially equidistantly spaced, charging means adapted for charging the electrode structures with a high voltage, collector plate means positioned between each electrode structure and adapted when said electrode structures are charged for creating an electrostatic field for treating the gas means for providing liquid on said plate means to flush particles therefrom, each discharge electrode structure including a horizontally extending cross member adjacent its lower end, and stabilizing means pendulously suspended from the cross member of each discharge electrode structure in free-swinging frictional engagement therewith for dampening the oscillation of the respective discharge electrode structure against any incurred influence of sparking between the electrode structures, and the associated collector plate means.

2. The precipitator according to claim 1 wherein said stabilizing means comprises an elongate upper portion mounted to frictionally engage the cross member of the respective electrode structure, a pendulum mass, and at least one rigid member rigidly connected between the pendulum mass and said elongate upper portion.

3. The precipitator according to claim 2 wherein the cross member of each electrode structure is arcuate in cross-section, said upper portion of each oscillation dampening means having a cross section frictionally engaging the arcuate surface of said cross member at least at opposite ends thereof.

4. An improved wet electrostatic precipitator including a housing having an inlet to receive gas to be treated and an outlet to discharge treated gas, a plurality of generally flat discharge electrodes, support means for rigidly suspending the electrodes from their upper ends within the housing in the flow path of the gas such that the electrodes are generally parallel to each other and substantially equidistantly spaced, charging means adapted for charging the electrodes with a high voltage, collector plate means positioned between each electrode and adapted when said electrode structure is charged for creating an electrostatic field for treating the gas and means for providing liquid on said plate means to flush particles therefrom, wherein the improvement comprises: each discharge electrode including a frame having a cross member adjacent its lower end, said support means includes support beams made from an electrically conductive material, means for rigidly and horizontally mounting the ends of the support beams to the precipitator housing, said charging means being electrically connected to the support beams, means for rigidly connecting the upper ends of the frames of the respective discharge electrodes to the beams to thereby establish a current path from the support beams to the discharge electrodes, and oscillation dampening means pendulously attached to the cross member of each discharge electrode structure in free-swinging frictional engagement therewith for dampening any incurred oscillation of the respective discharge electrode structure that may be induced by sparking between the electrode structures and the associated collector plate means.

5. The precipitator according to claim 4 wherein said oscillation dampening means comprises an elongate upper portion frictionally engaged upon the cross member of the respective electrode, a pendulum body portion, and at least one rigid portion rigidly connected between the body portion and said upper portion.

6. The precipitator according to claim 4 wherein the cross member of each discharge electrode is a straight cylindrical member, said upper portion of each oscillation dampening means having a cross section frictionally engaging said cylindrical member at two generally linear contact areas at opposite sides thereof.

* * * * *